US007867364B2

(12) United States Patent
Leeman et al.

(10) Patent No.: US 7,867,364 B2
(45) Date of Patent: Jan. 11, 2011

(54) DOCTOR BLADE HOLDER PERMITTING EFFICIENT ASSEMBLY OF DOCTOR ASSEMBLIES AND REPLACEMENT OF DOCTOR BLADES

(75) Inventors: David Leeman, Worcester, MA (US); Royal Gauvin, Windham, ME (US)

(73) Assignee: Kadant Inc., Westford, MA (US)

( * ) Notice: Subject to any disclaimer, the term of this patent is extended or adjusted under 35 U.S.C. 154(b) by 541 days.

(21) Appl. No.: 11/838,314

(22) Filed: Aug. 14, 2007

(65) Prior Publication Data

US 2008/0190579 A1 Aug. 14, 2008

Related U.S. Application Data

(60) Provisional application No. 60/838,117, filed on Aug. 16, 2006.

(51) Int. Cl.
*D21G 3/00* (2006.01)

(52) U.S. Cl. ..... 162/281; 162/272; 15/256.51

(58) Field of Classification Search ..... 162/280, 162/281, 199, 272; 15/256.51; 18/123, 261, 18/413

See application file for complete search history.

(56) References Cited

U.S. PATENT DOCUMENTS

| | | | |
|---|---|---|---|
| 1,696,119 | A | 12/1928 | Heisel |
| 1,912,605 | A | 6/1933 | Vickery |
| 2,890,473 | A | 6/1959 | Scott |
| 2,948,012 | A | 8/1960 | Scott |
| 3,040,442 | A | 6/1962 | Overton |
| 3,291,541 | A | 12/1966 | Dellinger |
| 3,593,663 | A | 7/1971 | Vischulis |
| 3,645,844 | A | 2/1972 | Grenier |
| 3,748,686 | A | 7/1973 | Winterburn et al. |
| 3,778,861 | A | 12/1973 | Goodnow |
| 3,780,670 | A | 12/1973 | Abler et al. |
| 3,803,665 | A | 4/1974 | Winterburn et al. |
| 3,854,162 | A | 12/1974 | Russell |
| 3,866,266 | A | 2/1975 | Dunlap |

(Continued)

FOREIGN PATENT DOCUMENTS

| | | |
|---|---|---|
| DE | 1055351 | 4/1959 |

(Continued)

*Primary Examiner*—Eric Hug
(74) *Attorney, Agent, or Firm*—Gauthier & Connors LLP

(57) ABSTRACT

A doctor assembly is disclosed for use in a paper-making machine. The doctor assembly includes a doctor blade holder into which a doctor blade may be inserted and the doctor blade holder includes a pressure plate, pressure adjustment system, a support tray, and a bracket in accordance with an embodiment. The pressure plate is for supporting and aligning the doctor blade in a cross machine direction for application to a machine roll. The pressure adjustment system is for adjusting the pressure applied to the machine roll by the doctor blade, said pressure adjustment means including at least one fluid reservoir having a wall that contacts the pressure plate. The support tray for supporting the at least one fluid reservoir, and the support tray includes at least one bracket alignment feature. The bracket is attached to the support tray for pivotal attachment to the pressure plate. The bracket includes at least one tray alignment feature that is coupled to the bracket alignment feature of the support tray to provide proper alignment of the bracket with respect to the support tray.

25 Claims, 6 Drawing Sheets

U.S. PATENT DOCUMENTS

| | | | | |
|---|---|---|---|---|
| 4,241,691 | A | 12/1980 | Hopfe et al. | |
| 4,367,120 | A | 1/1983 | Hendrikz | |
| 4,459,176 | A | 7/1984 | Goodnow | |
| 4,542,554 | A | 9/1985 | Wallerstein | |
| 4,665,859 | A | 5/1987 | Dunlap et al. | |
| 4,789,432 | A | 12/1988 | Goodnow et al. | |
| 4,821,672 | A | 4/1989 | Bruno | |
| 4,906,335 | A | 3/1990 | Goodnow et al. | |
| 5,070,783 | A | 12/1991 | Ireton | |
| 5,279,710 | A | 1/1994 | Aikawa | |
| 5,284,516 | A | 2/1994 | Sieberth | |
| 5,389,151 | A | 2/1995 | Fort | |
| 5,406,887 | A | 4/1995 | Hertel et al. | |
| 5,408,720 | A | 4/1995 | Miles | |
| 5,980,692 | A | 11/1999 | Goodnow | |
| 6,139,638 | A | 10/2000 | Dubois et al. | |
| 6,202,252 | B1 | 3/2001 | Harrisson | |
| 6,276,835 | B1 | 8/2001 | Reid et al. | |
| 6,312,563 | B1 | 11/2001 | Goodnow et al. | |
| 6,328,853 | B1 | 12/2001 | Goodnow et al. | |
| 6,447,646 | B1 | 9/2002 | Hassinen et al. | |
| 6,491,754 | B1 | 12/2002 | Graf et al. | |
| 6,524,444 | B2 | 2/2003 | Brauns et al. | |
| 6,786,999 | B2 | 9/2004 | Goodnow et al. | |
| 6,942,734 | B2 | 9/2005 | Rata et al. | |
| 2002/0174966 | A1 * | 11/2002 | Brauns et al. | 162/280 |
| 2004/0237884 | A1 * | 12/2004 | Rata et al. | 118/123 |
| 2006/0180291 | A1 | 8/2006 | Rata | |

FOREIGN PATENT DOCUMENTS

| | | | |
|---|---|---|---|
| DE | 1147105 | | 4/1963 |
| DE | 10225399 | | 12/2002 |
| EP | 0294992 | A2 | 12/1988 |
| EP | 0442165 | | 8/1991 |
| EP | 0485597 | A1 | 5/1992 |
| EP | 0294992 | | 6/1992 |
| EP | 0485597 | | 9/1996 |
| EP | 1123751 | | 8/2001 |
| EP | 1186703 | | 3/2002 |
| EP | 1186703 | A | 3/2002 |
| EP | 1186703 | A2 * | 3/2002 |
| EP | 1391552 | A1 * | 2/2004 |
| EP | 1734181 | A | 12/2006 |
| FR | 2690719 | | 11/1993 |
| FR | 2750465 | | 1/1998 |
| GB | 742882 | | 1/1956 |
| GB | 742882 | A | 1/1956 |
| GB | 886264 | | 1/1962 |
| GB | 990670 | | 4/1965 |
| JP | 11170478 | | 6/1999 |
| WO | 99/32717 | A | 7/1999 |
| WO | WO9964674 | | 12/1999 |
| WO | WO0044981 | | 8/2000 |
| WO | WO2004042143 | | 5/2004 |
| WO | WO2004067839 | | 8/2004 |

* cited by examiner

DOCTOR BLADE HOLDER PERMITTING EFFICIENT ASSEMBLY OF DOCTOR ASSEMBLIES AND REPLACEMENT OF DOCTOR BLADES

PRIORITY

This application claims priority to U.S. Provisional Patent Application Ser. No. 60/838,117 filed Aug. 16, 2006.

BACKGROUND OF THE INVENTION

1. Field of the Invention

This invention generally relates to doctors used in papermaking machines, and relates in particular to an improved doctor blade holder that is readily separable from and attachable to the doctor blade and removable from the papermaking machine for cleaning, inspection and repair.

2. Description of the Prior Art

Papermaking machines typically include a series of large rotating cylinders that variously form, squeeze and dry paper during its manufacture. The surfaces of these cylinders attract debris from the manufacturing process that must be removed to maintain product quality and process stability. Cleaning these roll surfaces is accomplished using devices commonly known as doctor assemblies. A doctor assembly typically includes a doctor blade, a doctor blade holder and the doctorback. The doctor blade should be perfectly flat, straight and have its longest axis parallel with the associated roll axis, and its composition must be compatible with the roll to be doctored.

The blade holder in concert with the doctor blade should exert a uniform designated load pressure on the roll surface. The blade holder holds the blade firmly against the roll, accommodates roll irregularities, and within limits, compensates for thermal expansion. The doctor back serves as the support structure for the doctor blade holder, and may be pivotally mounted on an axis that is also parallel with the roll axis. A loading mechanism may also be employed to bias the doctor blade against the roll.

In certain doctor assemblies, the blade holder may further include a top pressure plate (which holds the doctor blade), that is pivotally coupled to the doctor back via mounting hardware. The axis of rotation of this pivotal attachment is also parallel with the axis of rotation of the roll. The system may further include loading and unloading pneumatically controlled tubes on either side of the axis of rotation of the pivotal attachment of the top pressure plate to the mounting hardware attached to the doctor back. The loading and unloading tubes are for selectively advancing the doctor blade toward or away from the roll.

For example, U.S. Pat. No. 5,980,692 discloses a doctor assembly 10 that includes a doctor blade 14 that is attached to a blade holder 16 that is coupled to a doctor back 18 for doctoring a roll 12 as shown in FIG. 1. The doctor back 18 is pivotally coupled (about axis A2) to a loading mechanism 20. The blade holder 16 also includes fluid actuated unloading and loading tubes 30 and 32 respectively on either side of a pivotal attachment (A3) of a top pressure plate 34 (to which the doctor blade 14 is attached) to mounting hardware that is coupled to the doctor back 18 as further shown in FIG. 2.

The tubes 30 and 32 are supported by a tray 26 that holds the tubes in place, bracket 28 is attached to the tray 26, and the tray 26 is attached to the shelf 50 via fasteners that pass through holes provided in the tray 26. A depending bracket 36 that is welded or bolted to the top pressure plate 34 is pivotally attached to the bracket 28 as shown at A3 in FIG. 2. The bracket 28 is typically welded to the tray 26. Due to the harsh papermaking environment, tube trays are typically constructed of corrosion resistant materials, typically a 300 series stainless steel.

Assembling the blade holder 16, however, is a laborious process requiring great care in alignment and welding of the several brackets. There is a need, therefore, for an improved tube tray for a blade holder for a doctor blade assembly that is more efficient and economical to assemble.

SUMMARY

The invention provides a doctor assembly for use in a paper-making machine. The doctor assembly includes a doctor blade holder into which a doctor blade may be inserted, and the doctor blade holder includes a pressure plate, pressure adjustment system, a support tray, and a bracket. The pressure plate is for supporting and aligning the doctor blade in a cross machine direction for application to a machine roll. The pressure adjustment system is for adjusting the pressure applied to the machine roll by the doctor blade, said pressure adjustment means including at least one fluid reservoir having a wall that contacts the pressure plate. The support tray supports the fluid reservoir, and the support tray includes at least one bracket alignment feature. The bracket is attached to the support tray for pivotal attachment to the pressure plate. The bracket includes at least one tray alignment feature that is coupled to the bracket alignment feature of the support tray to provide proper alignment of the bracket with respect to the support tray.

In accordance with further embodiments, the support tray may be formed of a fiber reinforced composite, and the bracket alignment feature of the support tray may include either a channel or opposing retaining protrusions. In accordance with further embodiments, the support tray may further include an integral strip on an underside of said tray opposing the bracket alignment feature. The integral strip may extend in the cross-machine direction and be configured for attachment to a mounting plate coupled to a doctorback.

BRIEF DESCRIPTION OF THE DRAWINGS

The following description may be further understood with reference to the accompanying drawings in which.

The drawings are shown for illustrative purposes only and are not to scale.

DETAILED DESCRIPTION OF THE ILLUSTRATED EMBODIMENTS

Conventional tube trays are typically formed of stainless steel. The tube tray brackets and mounting strips are typically welded to the tray and are spaced uniformly along a line parallel to the tray centerline.

It has been discovered, however, that a tube tray for a doctor assembly blade holder may be constructed of corrosion-resistant polymeric materials in accordance with an embodiment of the invention that replaces the stainless steel tray. In accordance with certain embodiments, the invention provides for alignment features on the tray, and in accordance with further embodiments, the invention provides an integrated tray design that includes the brackets and tray in a single formed shape.

The tray of certain embodiments may be manufactured from a high strength, corrosion-resistant fiber reinforced polymeric composite (FRC) material such as, for example, vinylester, epoxy, or other thermoset or thermoplastic resins that contain reinforcement material such as fiberglass. The FRC materials may be specifically engineered to provide the required mechanical strength and toughness, chemical resistance, and high-temperature endurance. As engineering resins continue to evolve it is conceivable that some time in the future, no reinforcement material may be required, with the engineered resin having the capability to match the duty requirement(s) in its un-reinforced form. An integrated design has the added advantage relative to the conventional stainless steel tray of reducing assembly errors, assembly time and overall cost.

Figure 3A:
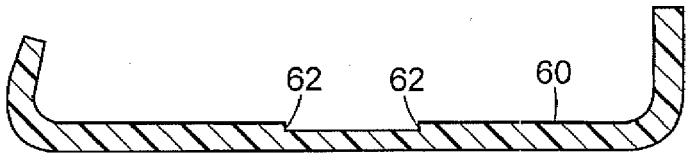
FIGS. 3A and 3B show illustrative sectional views of a tray and mounting bracket system in accordance with an embodiment of the present invention.
Figure 3B:
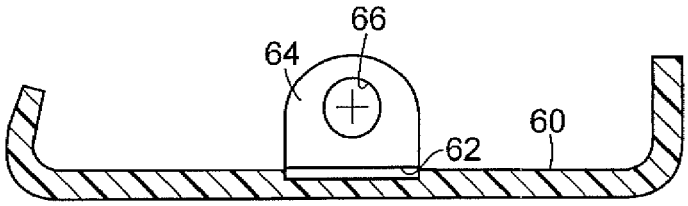

In accordance with a first embodiment of the present invention, and as shown in FIGS. 3A and 3B, a fiber reinforced composite (FRC) tray 60 is provided with a central channel 62 running along its entire length. The channel 62 serves to receive and align separately manufactured brackets 64 that serve to pivotally support a top plate carrying the doctor blade. The channel 62 serves to precisely align each bracket 64 as it is attached to the tray 60. A rod may be positioned within an aperture 66 in the bracket 64. The channel 62, therefore, provides an alignment feature that may be matched to the underside alignment shape of each bracket 64.

Figure 4A:
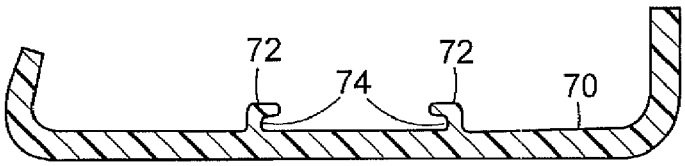
FIGS. 4A and 4B show illustrative sectional views of a tray and mounting bracket system in accordance with another embodiment of the present invention.
Figure 4B:
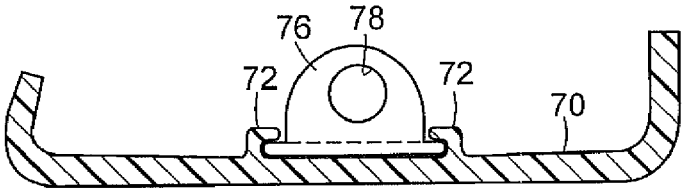

In accordance with another embodiment as shown in FIGS. 4A and 4B, the invention provides a support tray 70 formed of FRC material that includes mutually opposing spaced-apart hook-shaped shoulders 72 defining a channel 74 for receiving and aligning a separately manufactured bracket 76. A rod may be positioned within an aperture 78 in the bracket 76. In this embodiment, the alignment features 72 of the tray mate with the alignment features on the underside of the bracket 76.

Figure 5:
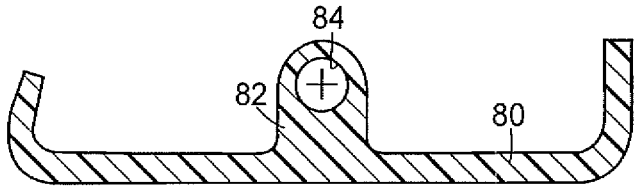
FIG. 5 shows an illustrative sectional view of a tray and mounting system in accordance with a further embodiment of the present invention.
Figure 6:
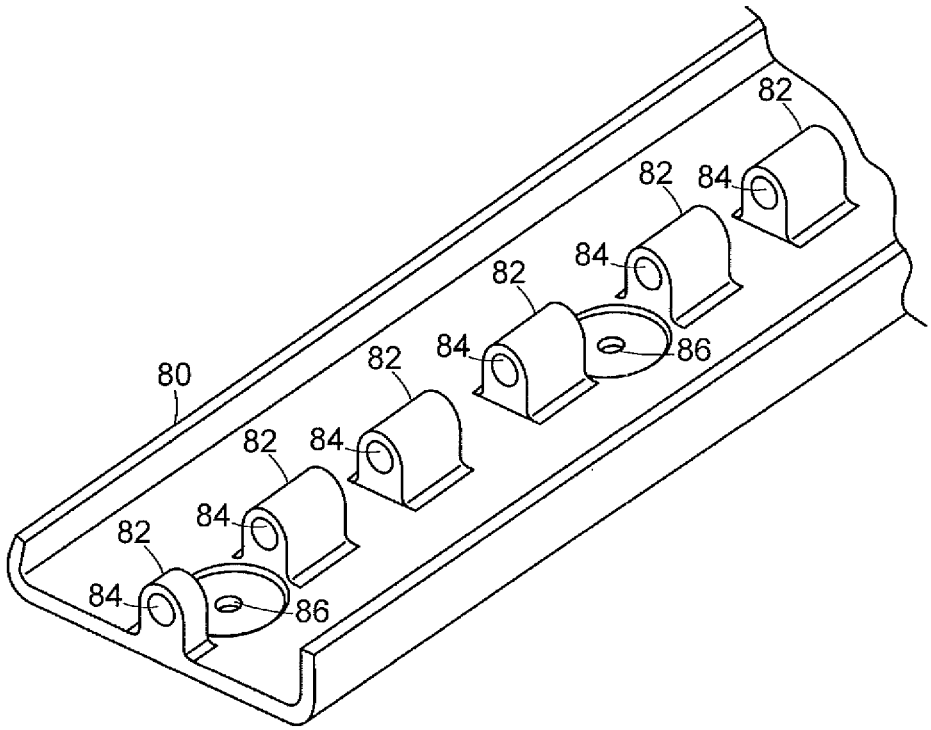
FIG. 6 shows an illustrative isometric view of the tray and mounting system shown in FIG. 5.

In accordance with a further embodiment of the invention, a blade holder may include a tray 80 of FRC material that includes integrally formed brackets 82 as shown in FIGS. 5 and 6. Each bracket includes an aperture 84 for receiving a rod. The tray also includes mounting holes 86 for receiving bolts for attaching the tray to a mounting strip or other structure coupled to a doctor back.

Figure 7:
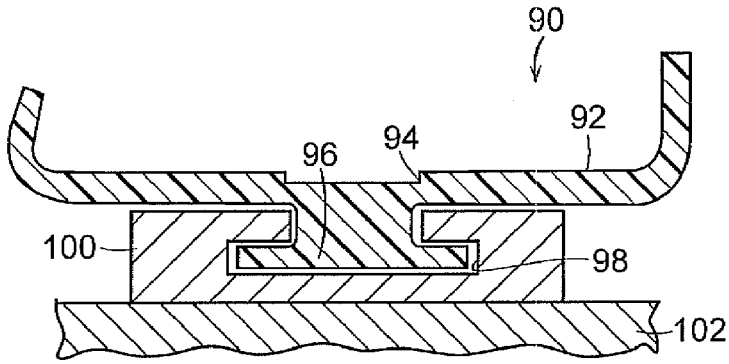
FIGS. 7-12 show illustrative sectional views of tray and mounting systems in accordance with further embodiments of the present invention.

In the embodiment shown in FIG. 7, a blade holder assembly 90 includes a tray 92 having a channel 94 for receiving a bracket as discussed above in connection with FIGS. 3A and 3B, as well as a sliding dovetail joint comprised of an integrally formed dovetail strip 96 designed to coact in sliding mechanical inter-engagement within a dovetail socket 98 cut into a mounting plate 100 secured to the doctorback 102. The channel 94 serves as a bracket alignment feature, and the strip 96 extends in the cross-machine direction and is configured for attachment to a mounting plate coupled to a doctorback.

Figure 8:
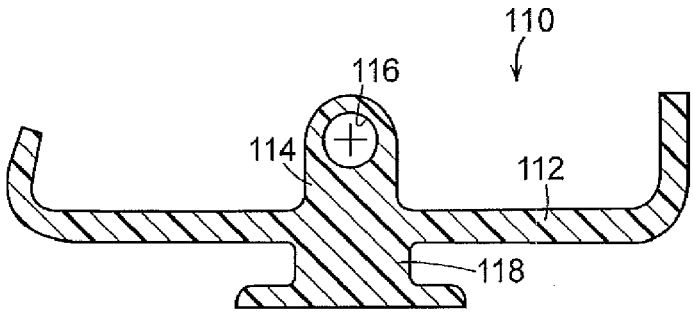
Figure 9:
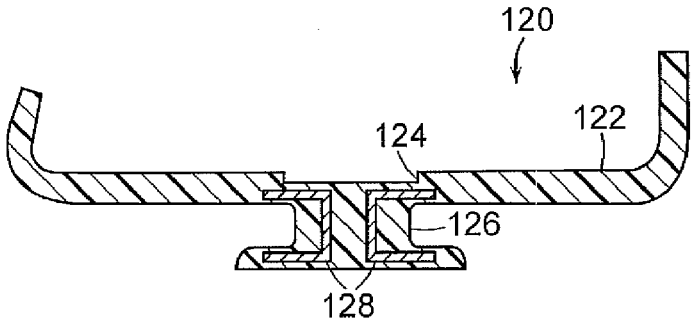

In the embodiment shown in FIG. 8, a blade holder assembly 110 may include a tray 112 having an integrally formed bracket 114 having an aperture 116 (as discussed above with reference to FIGS. 5 and 6), as well as an integrally formed mounting strip 118 (as discussed above with reference to FIG. 7). In the embodiment shown in FIG. 9, a blade holder assembly 120 may include a tray 122 having a channel 124 (as discussed above in connection with FIGS. 3A and 3B), as well as an integrally formed dovetail mounting strip 126 (as discussed above with reference to FIG. 7). The tray 122 also includes embedded strengthening material 128 within the strip and tray for added strength and stiffness. The strengthening material may include, for example, a metal or very stiff polymeric or ceramic material. The channel 124 serves as a bracket alignment feature, and the strip 126 extends in the cross-machine direction and is configured for attachment to a mounting plate coupled to a doctorback.

Figure 10:
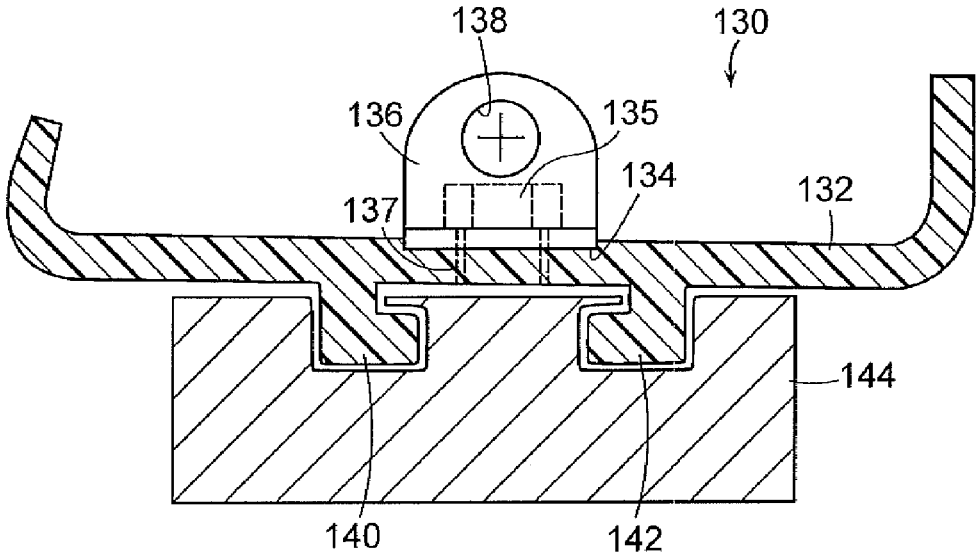

In the embodiment shown in FIG. 10, a blade holder assembly 130 includes a tray 132 having an integrally formed channel 134 for receiving a bracket 136, as well as having an integrally formed pair of opposing rails 140, 142 for receiving a dovetail mounting strip of a mounting plate 144. A rod is received in an aperture 138 of the bracket 136 as discussed above with reference to the above embodiments. The bracket 136 is affixed to the tray 132 via a fastener 135 which threads into an insert 137 which has been placed into the tray 132.

Figure 11:
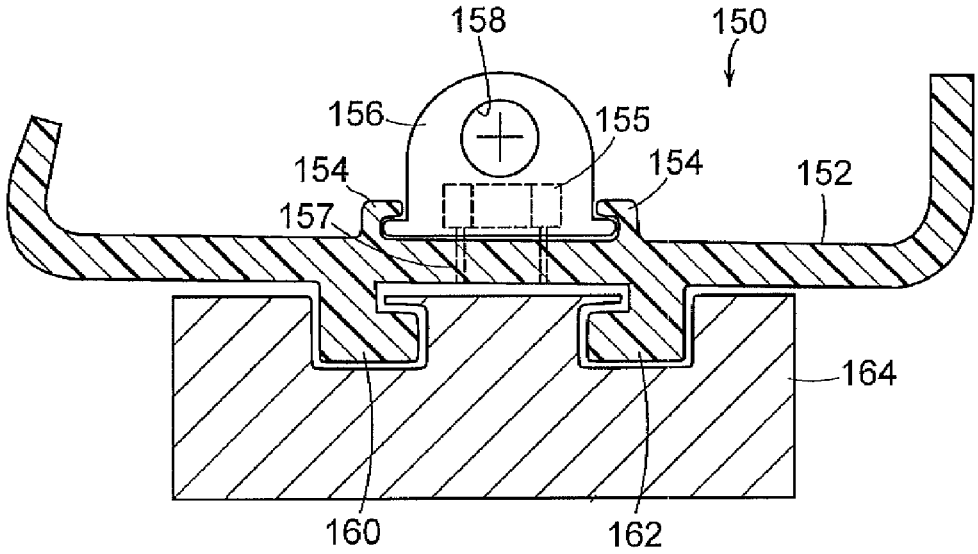

In the embodiment shown in FIG. 11, a blade holder assembly 150 includes a tray 152 having an integrally formed pair of opposing rails 154 for receiving a dovetail mounting strip of a bracket 156 having an aperture 158. The tray 152 also includes a pair of opposing rails 160, 162 for receiving a dovetail mounting strip of a mounting plate 164. The bracket 156 is affixed to the tray 152 via a fastener 155 which threads into an insert 157 which has been placed into the tray 152.

Figure 12:
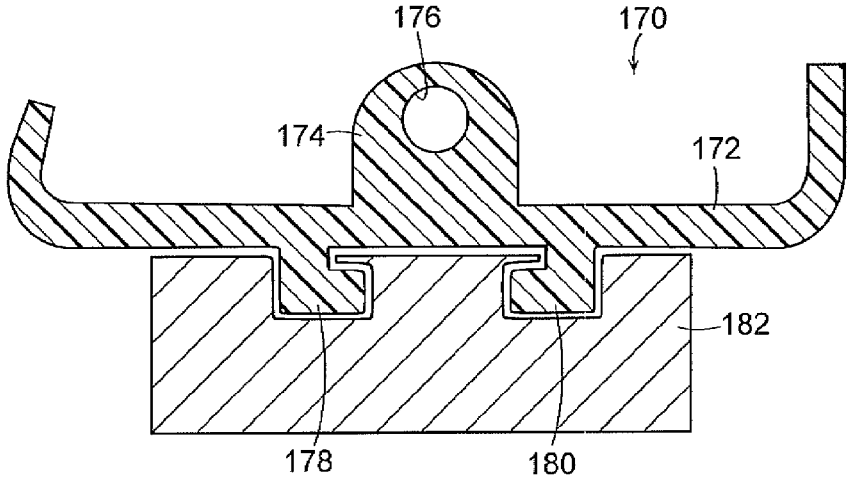

In the embodiment shown in FIG. 12, a blade holder assembly 170 includes a tray 172 having an integrally formed bracket 174 having an aperture 176, and includes a pair of opposing rails 178, 180 for receiving a dovetail mounting strip of a mounting plate 182.

Figure 1:
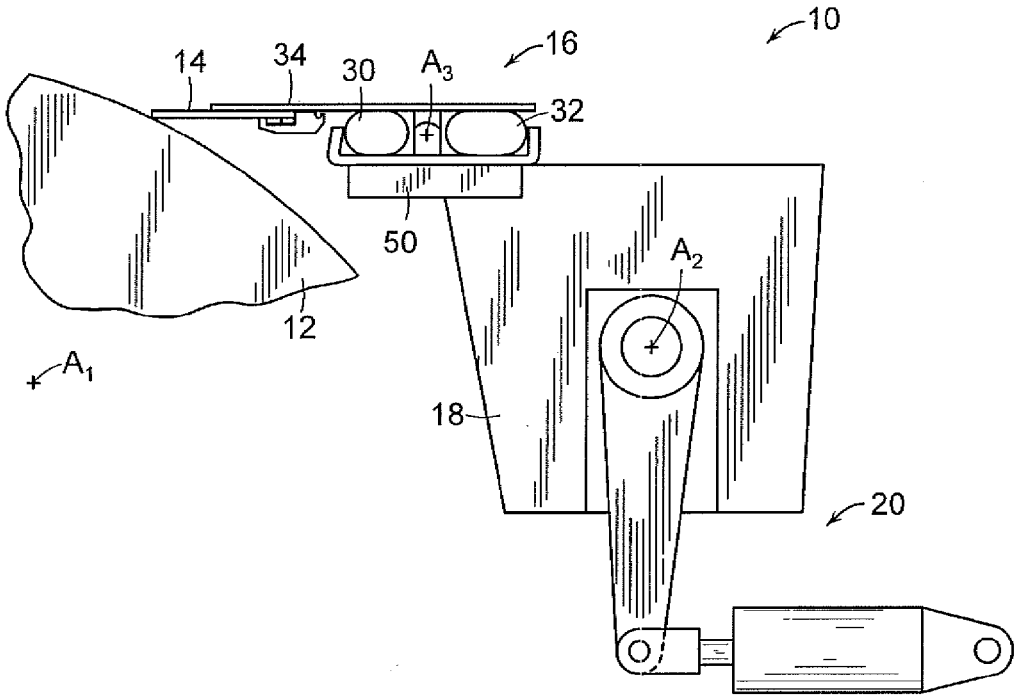
FIG. 1 (PRIOR ART)
FIG. 1 shows an illustrative diagrammatic side view of a doctor assembly in accordance with the prior art.
Figure 2:
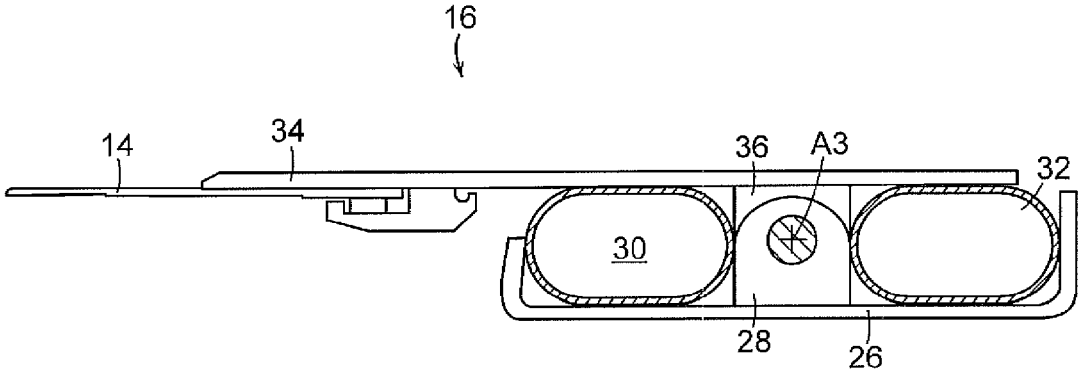
FIG. 2 (PRIOR ART)
FIG. 2 shows an illustrative diagrammatic view of an enlarged view of the blade holder illustrated in FIG. 1.

Each of the embodiments of the tray of FIGS. 3A, 3B, 4A, 4B and 5-12 may be used in place of the corresponding tray of FIGS. 1 and 2 as part of a doctor assembly for a paper-making machine.

The FRC trays of the present invention are preferably pultruded from a composite of reinforcing fibers and a suitable resin matrix. The fibers are preferably in continuous lengths, and may be glass, carbon, ceramic, aramid, rayon, polyester, basalt, or combinations thereof in any proportion. The resin matrix may be a vinylester, epoxy, or other thermoset or thermoplastic resins. Both the choice of fiber and resin depend on the tray's intended operating environment. A typical choice is a vinylester resin reinforced with fiberglass.

The resins may also be reinforced with discrete particles, organic or inorganic, and mixtures thereof in any proportion. Examples of organic particles being carbon, an aramid compound, and mixtures thereof in any proportion. Discrete inorganic particles may also be employed, examples being clay, calcium carbonate, talc, glass, gas-filled particles, and mixtures thereof in any proportion.

The FRC trays of the present invention may also be formed using other plastic forming techniques such as, but not limited to extrusion, injection molding or thermoforming. If additional strength is needed at the bracket locations, brackets made from higher strength material such as type 316 stainless steel could be inserted into or attached to the tray during its formation. Metal reinforcing elements may also be molded in situ at strategic locations within the trays The FRC trays of the present invention are attached to the doctor back in the same manner and using similar fasteners as for the conventional design. The remaining portions of the holder assembly attach to the FRC tray in the same manner and using the same components.

The embodiments of the present invention have the advantage of simplified construction while maintaining strength and corrosion resistance appropriate to the many different paper-making environments. The simplified construction and composite materials allow savings in material costs and assembly time.

Those skilled in the art will appreciate that numerous modifications and variation may be made to the above disclosed embodiments without departing from the spirit and scope of the invention.

What is claimed is:

1. A doctor assembly for use in a paper-making machine, said doctor assembly including a doctor blade holder into which a doctor blade may be inserted, said doctor blade holder comprising:

a pressure plate for supporting and aligning the doctor blade in a cross machine direction for application to a machine roll;

pressure adjustment means for adjusting the pressure applied to the machine roll by the doctor blade, said pressure adjustment means including at least one fluid reservoir having a wall that contacts said pressure plate;

a support tray for supporting said fluid reservoir, said support tray including at least one bracket alignment feature; and a bracket attached to said support tray for pivotal attachment to said pressure plate, said bracket including at least one tray alignment feature that is coupled to said bracket alignment feature of said support tray to provide proper alignment of said bracket with respect to said support tray, and wherein either the bracket alignment features are integrally formed with the support tray or the tray alignment features are integrally formed with the bracket.

2. The doctor assembly as claimed in claim 1, wherein said bracket alignment feature of said support tray includes a channel that extends in the cross-machine direction.

3. The doctor assembly as claimed in claim 1, wherein said bracket alignment feature of said support tray includes at least one pair of mutually opposing retaining protrusions that extend in the cross-machine direction and retain the bracket therebetween.

4. The doctor assembly as claimed in claim 1, wherein said support tray is formed of a polymeric material.

5. The doctor assembly as claimed in claim 1, wherein said support tray is formed of a fiber reinforced composite.

6. The doctor assembly as claimed in claim 5, wherein said fiber reinforced composite includes any of glass, carbon, ceramic, aramid, rayon, polyester, and basalt.

7. The doctor assembly as claimed in claim 1, wherein said support tray further includes an integral strip on an underside of said tray opposing said bracket alignment feature, said integral strip extending in the cross-machine direction and being configured for attachment to a mounting plate coupled to a doctorback.

8. The doctor assembly as claimed in claim 7, wherein said integral strip includes a reinforcement material.

9. A doctor assembly for use in a paper-making machine, said doctor assembly including a doctor blade holder into which a doctor blade may be inserted, said doctor blade holder comprising:

a pressure plate for supporting and aligning the doctor blade in a cross machine direction for application to a machine roll;

pressure adjustment means for adjusting the pressure applied to the machine roll by the doctor blade, said pressure adjustment means including a least one fluid reservoir having a wall that contacts said pressure plate;

a support tray for supporting said fluid reservoir, said support tray including a plurality of brackets that are integrally formed with said support tray, said plurality of integrally formed brackets providing for pivotal attachment to said pressure plate.

10. The doctor assembly as claimed in claim 9, wherein said support tray is formed of a polymeric material.

11. The doctor assembly as claimed in claim 9, wherein said support tray is formed of a fiber reinforced composite.

12. The doctor assembly as claimed in claim 11, wherein said fiber reinforced composite includes any of glass, carbon, ceramic, aramid, rayon, polyester, and basalt.

13. The doctor assembly as claimed in claim 9, wherein said support tray further includes an integral strip on an underside of said tray opposing said integral bracket, said integral strip extending in the cross-machine direction and being configured for attachment to a mounting plate coupled to a doctorback.

14. The doctor assembly as claimed in claim 13, wherein said integral strip includes a metal reinforcement material.

15. A doctor assembly for use in a paper-making machine, said doctor assembly including a doctor blade holder into which a doctor blade may be inserted, said doctor blade holder comprising:

a pressure plate for supporting and aligning the doctor blade in a cross machine direction for application to a machine roll;

pressure adjustment means for adjusting the pressure applied to the machine roll by the doctor blade, said pressure adjustment means including two separate fluid reservoirs, each of which has a wall that contacts said pressure plate;

a support tray for supporting said fluid reservoirs, said support tray including at least two bracket alignment features formed of a fiber reinforced composite; and a plurality of brackets attached to said support tray for pivotal attachment to said pressure plate between the two separate fluid reservoirs, each of said brackets including at least two tray alignment features that are coupled to said bracket alignment features of said support tray to provide proper alignment of said bracket with respect to said support tray.

16. The doctor assembly as claimed in claim 15, wherein said bracket alignment feature of said support tray includes a channel that extends in the cross-machine direction.

17. The doctor assembly as claimed in claim 15, wherein said bracket alignment feature of said support tray includes a pair of mutually opposing retaining protrusions that extend in the cross-machine direction and retain the bracket therebetween.

18. The doctor assembly as claimed in claim 15, wherein said fiber reinforced composite includes any of glass, carbon, ceramic, aramid, rayon, polyester, and basalt.

19. The doctor assembly as claimed in claim 15, wherein said support tray further includes an integral strip on an underside of said tray opposing said bracket alignment feature, said integral strip extending in the cross-machine direction and being configured for attachment to a mounting plate coupled to a doctorback.

20. The doctor assembly as claimed in claim 19, wherein said bracket alignment feature of said support tray include a dovetail mounting strip for engaging mutually opposing retaining portions of a mounting plate.

21. A doctor assembly for use in a paper-making machine, said doctor assembly including a doctor blade holder into which a doctor blade may be inserted, said doctor blade holder comprising:

a pressure plate for supporting and aligning the doctor blade in a cross machine direction for application to a machine roll;

pressure adjustment means for adjusting the pressure applied to the machine roll by the doctor blade, said pressure adjustment means including at least one fluid reservoir having a wall that contacts said pressure plate;

a support tray for supporting said at least one fluid reservoir, said support tray including at least one mounting plate coupling structure for coupling to a mounting plate, said at least one mounting plate coupling structure being integrally formed with said support tray;

wherein said mounting plate includes at least one support tray coupling structure receiving the at least one mounting plate coupling structure of said support tray.

22. The doctor assembly as claimed in claim 21, wherein said support tray includes at least two mounting plate coupling structures for coupling to the mounting plate.

23. The doctor assembly as claimed in claim 21, wherein said support tray includes two mutually opposing mounting plate coupling structures.

24. The doctor assembly as claimed in claim 23, wherein said two mutually opposing mounting plate coupling structures each includes a rail edge that extends toward a rail edge of the other opposing mounting plate coupling structure.

25. The doctor assembly as claimed in claim 21, wherein said support tray includes at least two brackets that are integrally formed with said support tray for providing pivotal attachment of said pressure plate to said support tray.

* * * * *